US005524361A

United States Patent [19]

Dexter et al.

[11] Patent Number: 5,524,361

[45] Date of Patent: Jun. 11, 1996

[54] FLATLINE METHOD OF DRYING WAFERS

[75] Inventors: Jeffrey L. Dexter; David C. Siemers; Larry J. Head, all of Evansville, Ind.

[73] Assignee: George Koch Sons, Inc., Evansville, Ind.

[21] Appl. No.: 388,075

[22] Filed: Feb. 14, 1995

[51] Int. Cl.[6] ..... F26B 3/00

[52] U.S. Cl. ..... 34/502; 34/500

[58] Field of Search ..... 34/73, 76, 500, 34/502, 509

[56] References Cited

U.S. PATENT DOCUMENTS

| | | | |
|---|---|---|---|
| 2,057,681 | 10/1936 | Harrington | 34/502 |
| 2,336,698 | 12/1943 | Morrill | 34/500 |
| 2,346,176 | 4/1944 | McAleer | 34/500 |
| 4,206,553 | 6/1980 | Ellison et al. | 34/502 |
| 4,338,079 | 7/1982 | Faulkner et al. | 34/502 |
| 4,658,513 | 4/1987 | Strattman | 34/73 |
| 5,341,580 | 8/1994 | Teal . | |

*Primary Examiner*—John T. Kwon
*Attorney, Agent, or Firm*—David H. Semmes

[57] ABSTRACT

Drying of particulate materials, such as wood chips (wafers/strands) for the manufacture of oriented structural board, as well as bark, and the like. The method is characterized by advancing wafers in random array and superposed and without contact above a planar surface; forcing heated air upwardly through spaced apart holes defined in the stationary planar surface and through the random array of advancing wafers, while evacuating heated air and accumulated moisture above the advancing wafers. The method is distinguished by lateral shielding during forcing of heated air above the planar surface, so as to inhibit "blow-holes" among the drying wafers.

9 Claims, 10 Drawing Sheets

FLATLINE METHOD OF DRYING WAFERS

BACKGROUND OF THE INVENTION

1. Field of the Invention

Drying of particulate material, such as wood chips (wafers/strands) for manufacture of oriented structural board (OSB), bark, and the like.

2. Description of the Prior Art

Pertinent prior patents and publications:

| | |
|---|---|
| PROCTOR | 473,263 |
| KEHOE | 1,751,552 |
| KLINKMUELLER | 3,510,956 |
| MULLIN | 4,099,338 |
| TEAL | 5,341,580 |

Being discussed in a separate Information Disclosure Statement.

SUMMARY OF THE INVENTION

The present invention is an improved, low temperature, high production method for drying wood wafers that may be used in the production of Oriented Structural Board (OSB). A suggested oven exhibits superior drying performance, as compared to conventional rotary dryers due to the utilization of high volumes of low temperature air with consequent reduced volatile organic compound (VOC) emissions, and higher output percentages of usable product. Key features of the invention include the use of perforated belt support plates or platens, in combination with a flat wire conveyor belt, to provide uniform distribution of air to the bottom side of the superposed product, which is out of contact with the platens, creating an aerating effect as the air flows vertically upward through the product. Variable speed "Picker Rolls" are used periodically throughout the dryer to reorient the product and expose fresh surfaces of product to air flow. The flat wire belt is used, also, to remove fines collected in the supply air plenum and to avoid "blow-holes" within the wood product being dried. Utilization of expanded, sloped walls in the main drying chamber reduces air velocity, which facilitates material fines dropping out of the air stream. Utilization of a waste-wood burner as the primary heat source and pollution control device enables the return of portions of the exhausted air stream from the drying process to the waste-wood burner to reduce the emissions of pollutants to the environment.

Flat line or conveyor drying of wood "particles" is not new. The prior art references such as "Proctor" and "Kehoe" clearly show this subject matter. The Teal U.S. Pat. No. 5,341,580, however, seems to be oblivious to the state of prior art. The technique of drying by forcing large volumes of low temperature air through lightweight wafers poses unique problems which are solved by the method of the present invention. For example, the flow of air downwardly through the product tends to restrict air flow, in that a "blocking" effect takes place similar to filters being "blocked" when dust and particles collect on the filter's surface and retard air flow. The concept of restricting air movement to the vertical upward direction through the material, also, presents problems in the drying of wood wafers. Manifestly, the drying phenomena are enhanced due to the aerating effect caused by the upward movement of air through the product, assuming that air is supplied to the bottom surface of the material at pressures that enable uniform distribution. The air is supplied with adequate pressure to diffuse into the surface of the material being dried and causes an aerating effect as it is distributed upward through the product. Care must be taken, however, to limit the mass flow of air in order to prevent excessive aeration that causes the product to become airborne and disrupts the product flow through the dryer.

Flat line drying facilitates the use of recirculated air flow. The air is circulated in a continuous path from the discharge of a fan, through a heat exchanger, through or across the product, and returned to the circulating fan with portions of the air mass being exhausted and replaced with equivalent amounts of fresh air. Since the air stream in a flat line dryer is not used to transport the product through the dryer, as in rotary drying, the exhaust volume can be regulated, thereby controlling the environment within the dryer. The dwell time, temperature, turbulent mass air flow, and humidity within the dryer determine the drying effectiveness. As the environment becomes saturated with water vapor, the drying process reaches equilibrium and drying can be optimized by varying the locations and volumes of air exhausted during the drying process.

Water vapor from the drying process can be returned to a waste wood burner which reduces Nitrous Oxide (NOx) emissions. Thus, significant reductions in NOx emissions can be accomplished by regulating the amount of moisture returned to the waste wood burner. Also, the VOC's released during the drying process can be returned to the waste wood burner for incineration, resulting in further reduction of pollutants. Since waste wood burners are the preferred heat source for OSB production and there is typically an over-abundance of hog fuel (waste wood/bark) available, the increased energy consumption necessitated by the return of moisture to the burner, results in a more equitable fuel to product ratio and less solid waste accumulation.

Due to the low mass of some of the individual wafers and particles being dried in conventional flat line wafer dryers, some of the wafers, as well as fines, become airborne and are circulated within the air stream used to dry the product. These particles tend to accumulate in the supply plenum and can become over-dried creating a fire hazard. By routing the return pass of the conveyor belt through the bottom of the plenum, it is possible to remove the fines from the plenum. The suggested flat wire conveyor belt serves as a continuous plenum cleaning device by dragging the fines along the bottom surface of the air plenum and depositing them into a collection point external to the plenum.

The air supplied to the bottom surface of the wafer layer passes through stationary perforated conveyor support plates that have a relatively small percentage of open area as compared to the total surface area of the product being transported. The velocity of the air through these perforations is relatively high which allows the air stream to penetrate the bottom surface of the product layer and disrupt the layer as it flows upwardly through it. The mass of the material creates a natural resistance to air flow, which forces the air to dissipate through the entire cross-sectional area. This action reduces the upward velocity as the air mass expands to fill the cross-sectional area. The results of the air mass dissipating throughout the cross-sectional area of the material are uniform distribution of air to the product, uniform heat transfer, and uniform evaporation of the moisture contained within the product.

The upward velocity of the air is further reduced due to the construction of the chamber directly above the material layer. The side walls of the chamber are sloped outwardly to present an increasing cross-sectional area as the air travels upwardly. This causes the air velocity to gradually reduce and allows larger fines to drop out of the air stream due to gravity, prior to the air entering the intake cones of the fans used to circulate the thermal air mass within the dryer.

A need exists within the OSB industry for a high volume, low temperature dryer suitable for drying a wide variety of wood species while satisfying the requirements set forth by the Environmental Protection Agency with respect to airborne pollutants. There is an additional need for a safe alternative to the current methods used in the drying of wood wafers. Lower operating temperatures and the use of a fines management system offer significant safety improvements which result in reduced risk of fire while delivering the quality of product necessary in the OSB industry.

The suggested method of flat line wafer drying includes a low temperature, high production wood wafer dryer system offering superior drying performance, while substantially reducing the release of volatile organic compounds and other regulated emissions into the atmosphere. It has been known for years that reducing the moisture content of wood wafers at processing temperatures of 450° F. and less is extremely beneficial in both reducing VOC's and increasing the structural integrity (strength) of the end product. Due to low processing temperatures and low exhaust volumes, the dryer can help the producers of oriented structural board meet emission regulations established by the Environmental Protection Agency, while eliminating or reducing the size and cost of expensive "add-on" pollution control devices.

DESCRIPTION OF THE PREFERRED EMBODIMENTS

Figure 1:
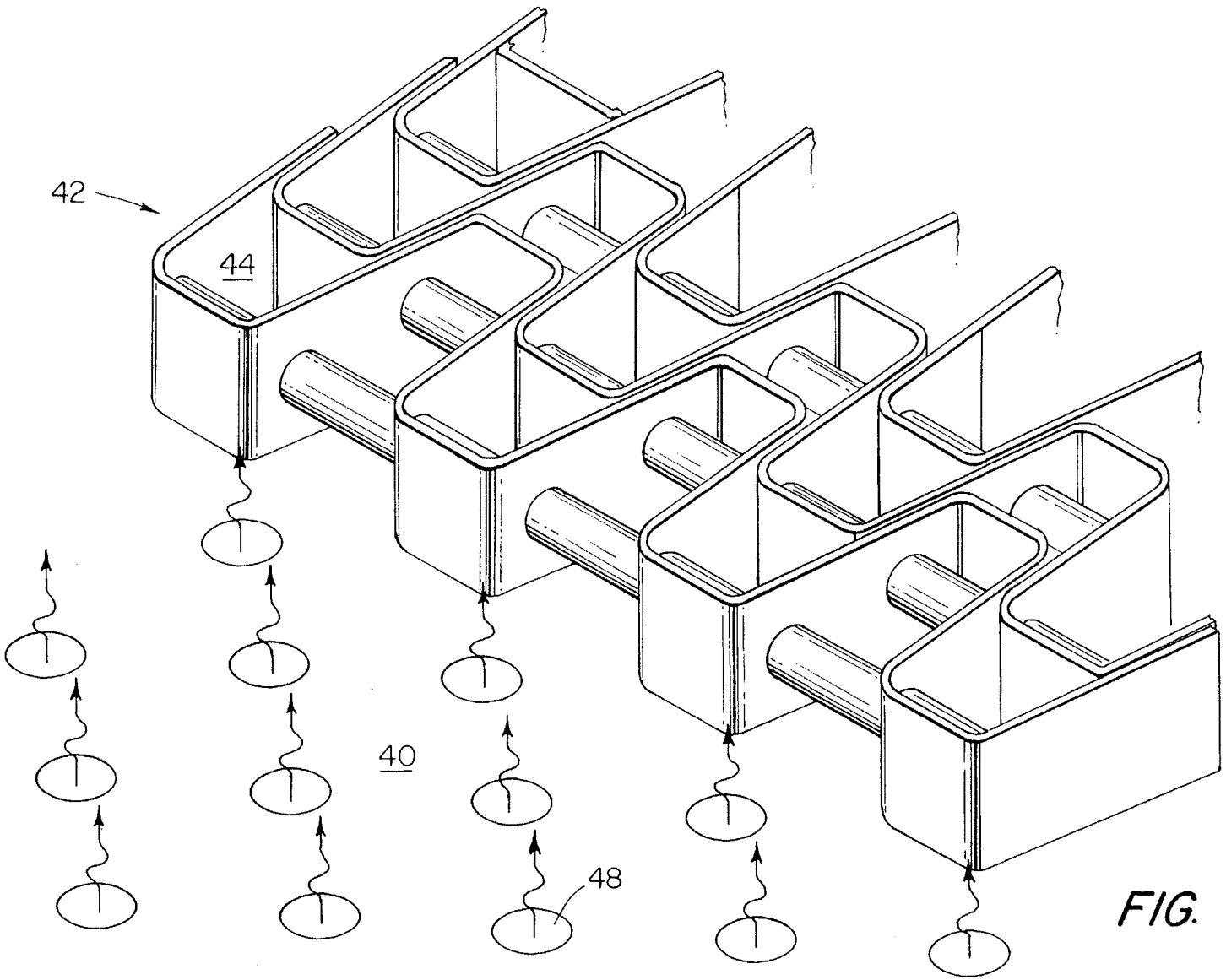
FIG. 1 is an enlarged fragmentary perspective of the stationary perforated platen 40, supporting a flat wire conveyor belt 42.
Figure 2:
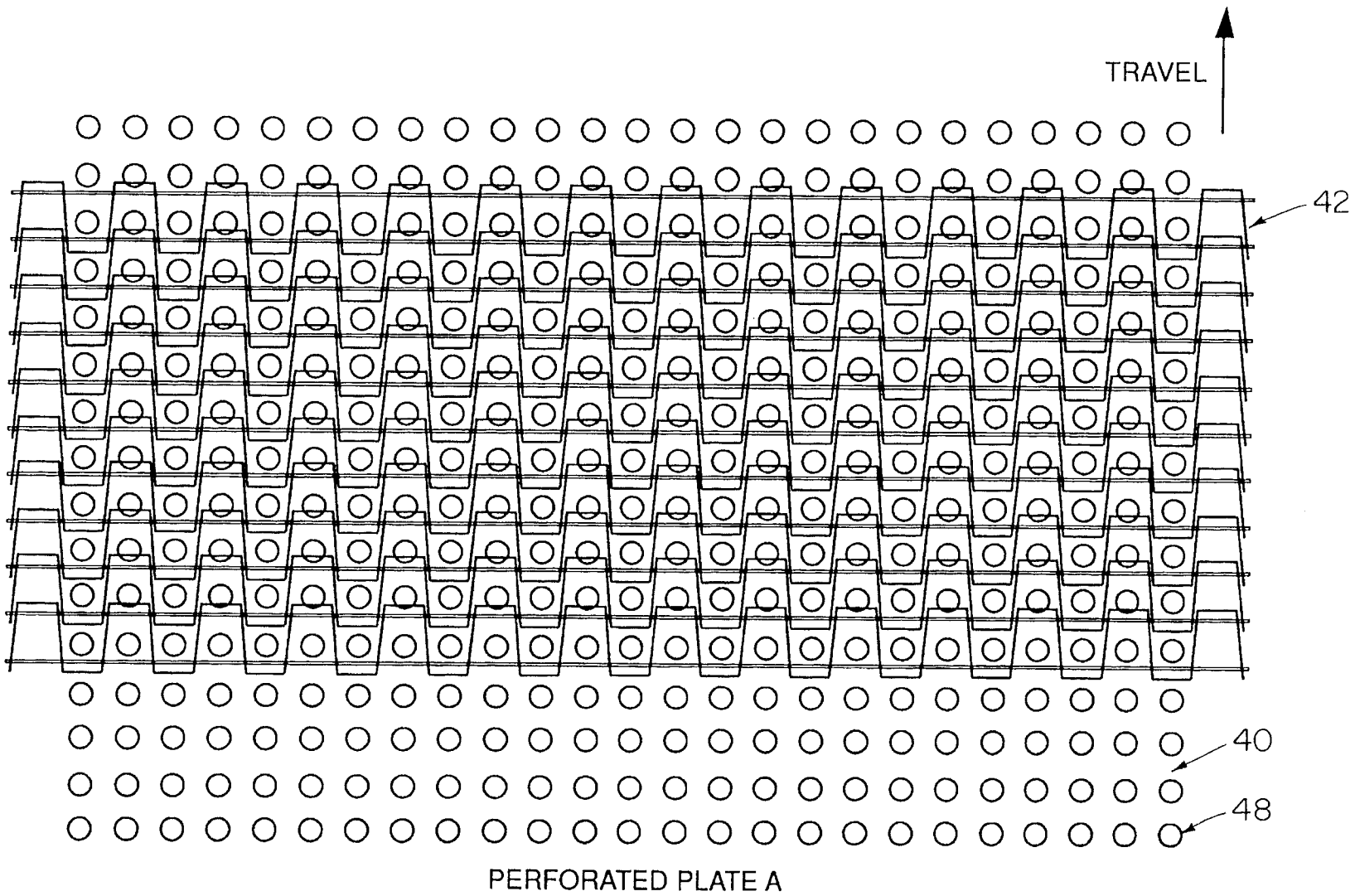
FIG. 2 is a fragmentary top plan showing the combination of a perforated platen 40 and a flat wire conveyor belt 42.
Figure 3:
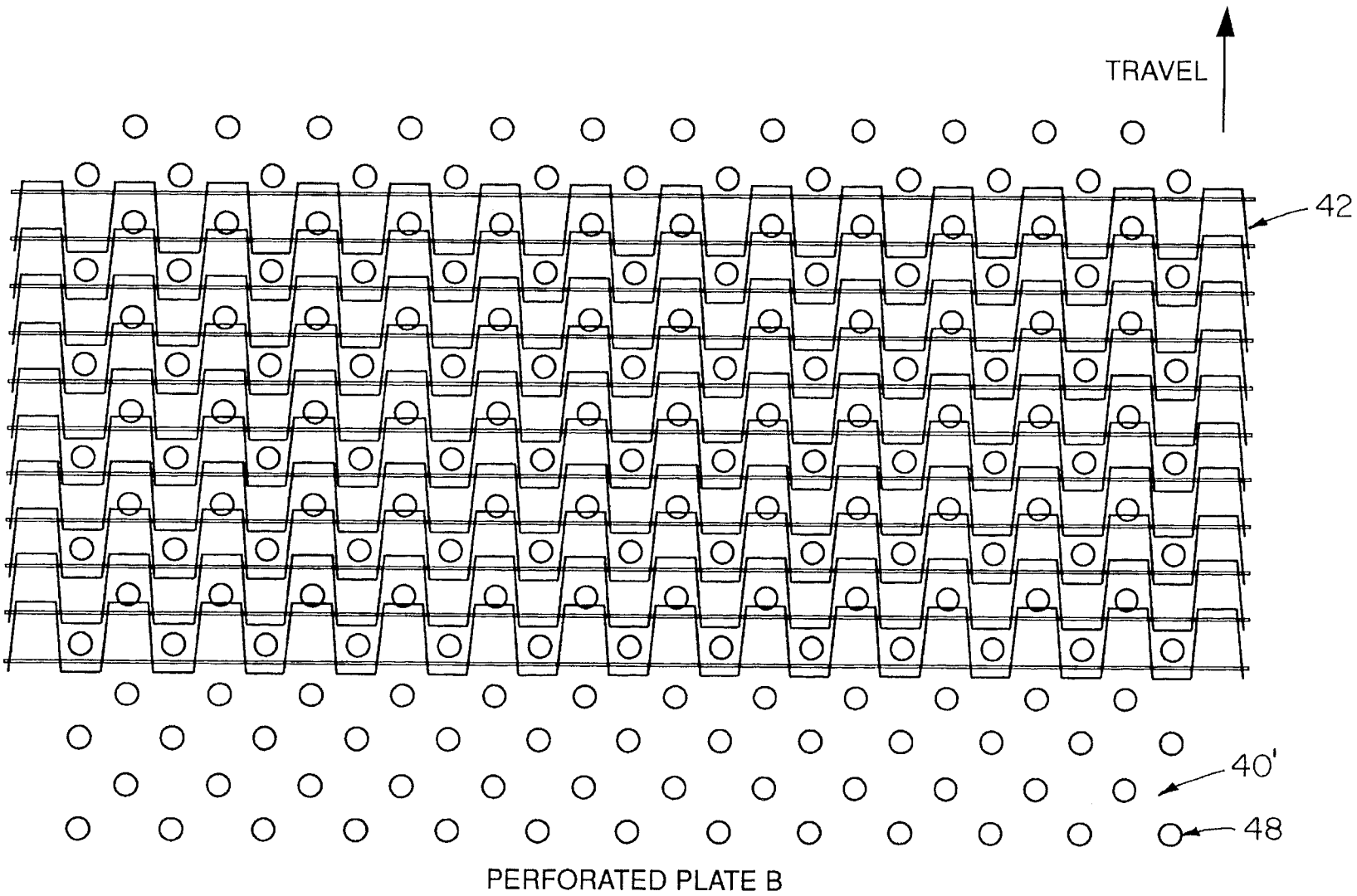
FIG. 3 is a fragmentary top plan of a perforated platen 40' and a flat wire conveyor belt 42 wherein the holes in the platen are spaced apart at a greater distance than in FIG. 2.
Figure 4:
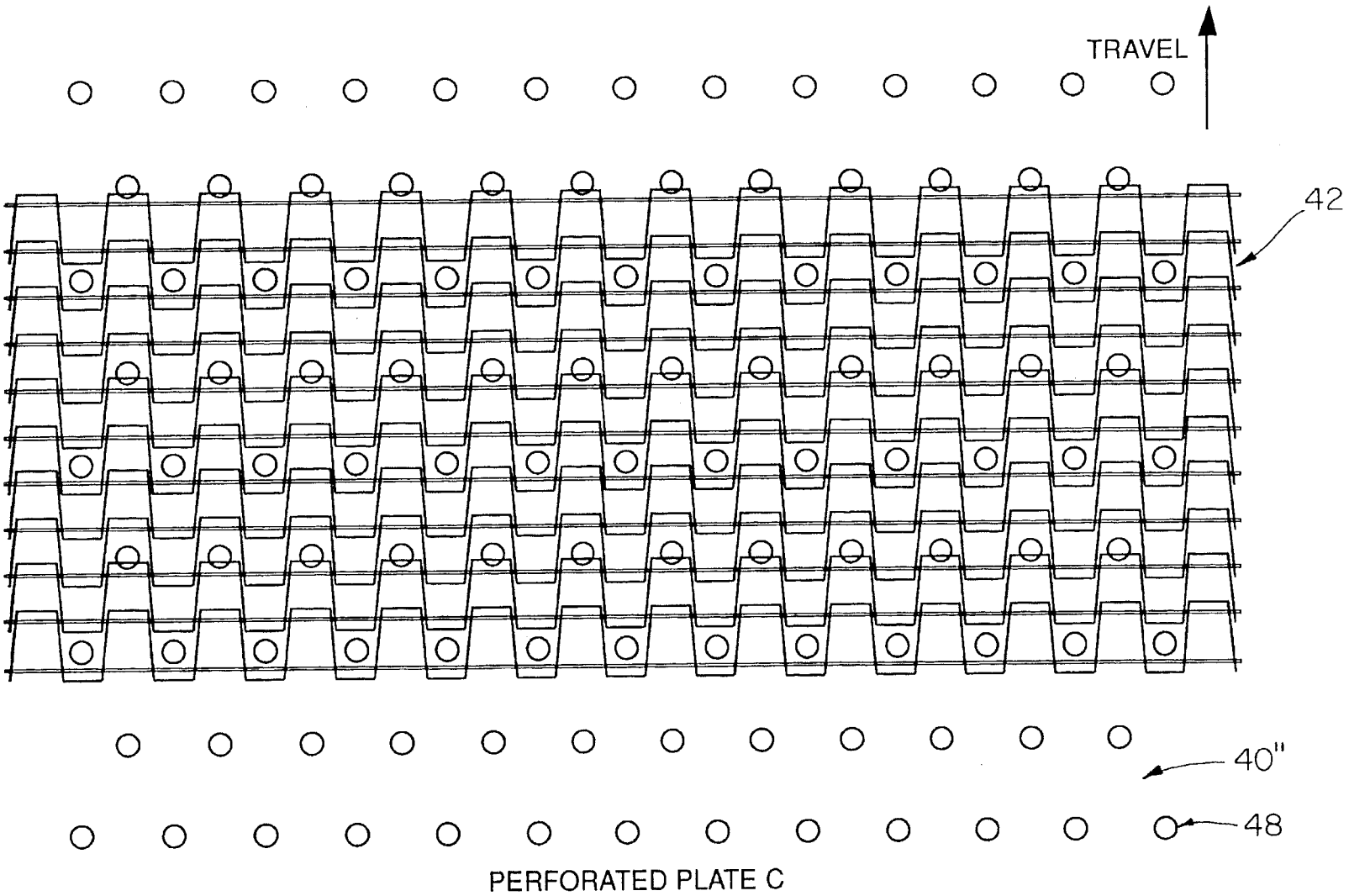
FIG. 4 is a fragmentary top plan of a perforated platen 40" and a flat wire conveyor belt 42 wherein the holes or apertures 48 are spaced apart at a greater distance than in FIGS. 2 and 3.

The preferred embodiment of the flat line wafer dryer includes an in-line oven consisting of multiple zones 20, 22, 24; each zone consisting of three individual heating/drying sections 26, 28, 30; and each heating/drying section consists of two heater housings 32, 34. Each heater housing contains a fan 36 which supplies and recirculates heated air through the secondary heat exchanger 38 and product 58. High volumes of air, which provide high mass flow rates, are recirculated through the product. This allows for lower operating temperatures.

The preferred embodiment of the flat line wafer dryer may utilize a conventional waste wood burner (not illustrated) as the primary heating device. The waste wood burner transfers the thermal energy to secondary heat exchangers 38 used within the body of the flat line wafer dryer. The preferred embodiment utilizes thermal oil heat exchangers 38 for the secondary heating devices. Such thermal oil heat exchangers 38 are located within each of the heater housings 32, 34 provided throughout the length of the flat line wafer dryer. Each heater housing 32, 34 is equipped with a circulation fan 36 and heat exchanger 38 to transfer heat to the air mass circulated within each section 26, 28, 30 of each zone 20, 22, 24 of the flat line wafer dryer. The size of each thermal oil heat exchanger 38, the flow of thermal oil to the heat exchangers, and the air volumes circulated within each section 26, 28, 30 can be varied as necessary to provide a controlled drying process.

In order to exercise control of the drying process, it is necessary to control both the rate of evaporation of the water and release of VOC's from the product. A means 56 of controlling the exhaust air volume within individual sections of the dryer is provided in the illustrated embodiment, making it possible to control the moisture content of the air circulated within the individual sections. As the moisture concentration approaches saturation (dew point), the ability of the air to accept additional moisture, and hold it in suspension, is diminished. This is, also, true for VOC's. VOC's have a wide range of evaporation temperatures; some VOC's evaporate at lower temperatures than water and some at higher temperatures than water. The VOC's contained within different wood species vary, as do the temperatures at which they are released. The environment within individual sections is controlled to optimize the VOC removal for these variations in wood species. By controlling the thermal mass (temperature/air flow) of the circulated air and the moisture concentration of the air within a given section, it is possible to vary both the VOC and water concentrations of the air streams. Controlling the exhaust air streams from these controlled environments enables removal of VOC's at optimum locations within the dryer. In the preferred embodiment, these VOC's are then directed to various locations of a waste wood burner for incineration. The preferred embodiment provides the exhaust port locations down stream of the heat exchanger 38 to allow the air mass to be heated well above the dew point of the air that has passed through the product layer. This reduces the potential for condensation of the water from the exhaust air stream as it travels through the exhaust duct toward a down stream process.

As will be noted, a flat wire conveyor belt is utilized in the preferred embodiment of the flat line wafer drying system. Conventional woven wire belts, used in wafer drying, are constructed such that there are cavities existing between the upper and lower surfaces of the woven-wire belt. These cavities are the result of wires wound in a helical pattern from one cross-pin to the next cross-pin. This creates an elongated tubular or oval cavity between the upper and lower surfaces of the belt and between each adjacent cross-pin. Air supplied at multiple points along the width of the belt can travel laterally within these cavities defined between the upper and lower surfaces of the belt. As wood wafer product density varies above the surface of the belt, the air that travels laterally within these cavities and below the product surface, escapes through weak spots in the product defined by areas of low product density. This causes "blow-holes" which result from excessive air flow disrupting and displacing the wafers in these low density areas. Due to the absence of the material in the vicinity of a "blow-hole", there is little resistance to air flow, which encourages air to move laterally beneath the surface of the product to the location of the "blow-hole". This allows excess air to come in contact with wafers adjacent to the "blow-holes", while by-passing wafers located in areas of higher product density. Accordingly, the wafers adjacent to the "blow-holes" become excessively dry. This over-drying of these wafers causes excessive release of VOC's in the form of "blue haze". ("Blue haze" is a term used in the wood industry to depict the visual appearance of smoke that is indicative of the excessive release of VOC's prior to actual combustion of the product.) Meanwhile, those wafers located in the areas of higher product density, are not dried sufficiently, due to the by passing of air to the "blow-holes". This results in non-uniform drying of wafers, as well as excessive VOC emissions.

Within the preferred embodiment illustrated in FIGS. 5–11, each zone of the suggested dryer is equipped with an air supply plenum 54 utilizing stationary foraminous steel plates 40, designed to support a steel flat wire conveyor belt 42 which transports the wood wafers 58 through the dryer. Flat wire conveyor belt 42 is constructed such that there are small semi-rectangular openings or cells 44 that are isolated laterally. These cells 44 are open on the top and bottom surfaces of the belt and allow air, delivered to the perforated belt support plates 40 via the air supply plenum, to enter from the bottom surface of the belt. Due to the enclosed cell walls, air is laterally shielded and delivered directly to the bottom surface of the superposed wood product layer 58 being transported by the flat wire conveyor belt 42. The cell structure, 44, which is created as a result of the belt construction, prevents air from flowing laterally below the surface of the material and escaping through non-uniform material layers above the belt and, also, enables advancing of superposed product 58 out of contact with perforated plate 40. The perforated steel plates 40 offer a resistance to air flow which provides uniform distribution of air to the lower surface of the belt. This results in a uniform distribution of air to the bottom surface of the product being dried 58, which further results in a uniform distribution of air through the product. By thusly restricting the lateral path of the air beneath the product layer 58, it is possible to supply the air uniformly to the bottom of the product layer and cause the air to percolate upwardly through the product. This results in more uniform drying of the product and less VOC (blue haze) emission.

Flat wire belt 42 serves an additional purpose within the suggested embodiment in that it is used to remove the fine wood particles from the air supply plenum on its return pass through the dryer. Conventionally, wood fines are sometimes entrained in the recirculating air stream of the dryer and deposited in the supply plenum due to the low air velocity below the perforated steel plates. The suggested cell structure of the flat wire conveyor belt is used to drag fines out of the lower plenum return "slider bed" 46. Thus, the flat wire conveyor belt 42 serves the additional function of providing a continuous sweeping of fines from the lower supply plenum 54. This sweeping of fines from the lower plenum as at 46 in FIG. 11 reduces the risk of fire, due to the elimination of a build up of fines.

Each zone 20, 22, 24 in the preferred embodiment of the flat line wafer dryer contains a lower supply plenum 54 which is separated into three distinct sections 26, 28, 30 with air supplied, respectively, from six separate heater housings 32 and 34. Two heater housings 32, 34, each containing a circulation fan 36 and heat exchanger 38, are used to supply air to each of the three separate sections. This separation of heater housings allows air to be delivered uniformly throughout the length of the plenum. Septum sheets or dividers 60 may be used to separate the three distinct sections of each zone, thereby allowing the internal plenum pressures to vary slightly from section to section. The fans for each section may be varied to control the thermal air mass supplied to the individual sections so as to effect a controlled and variable flow of air throughout the length of the plenum.

Figure 5:
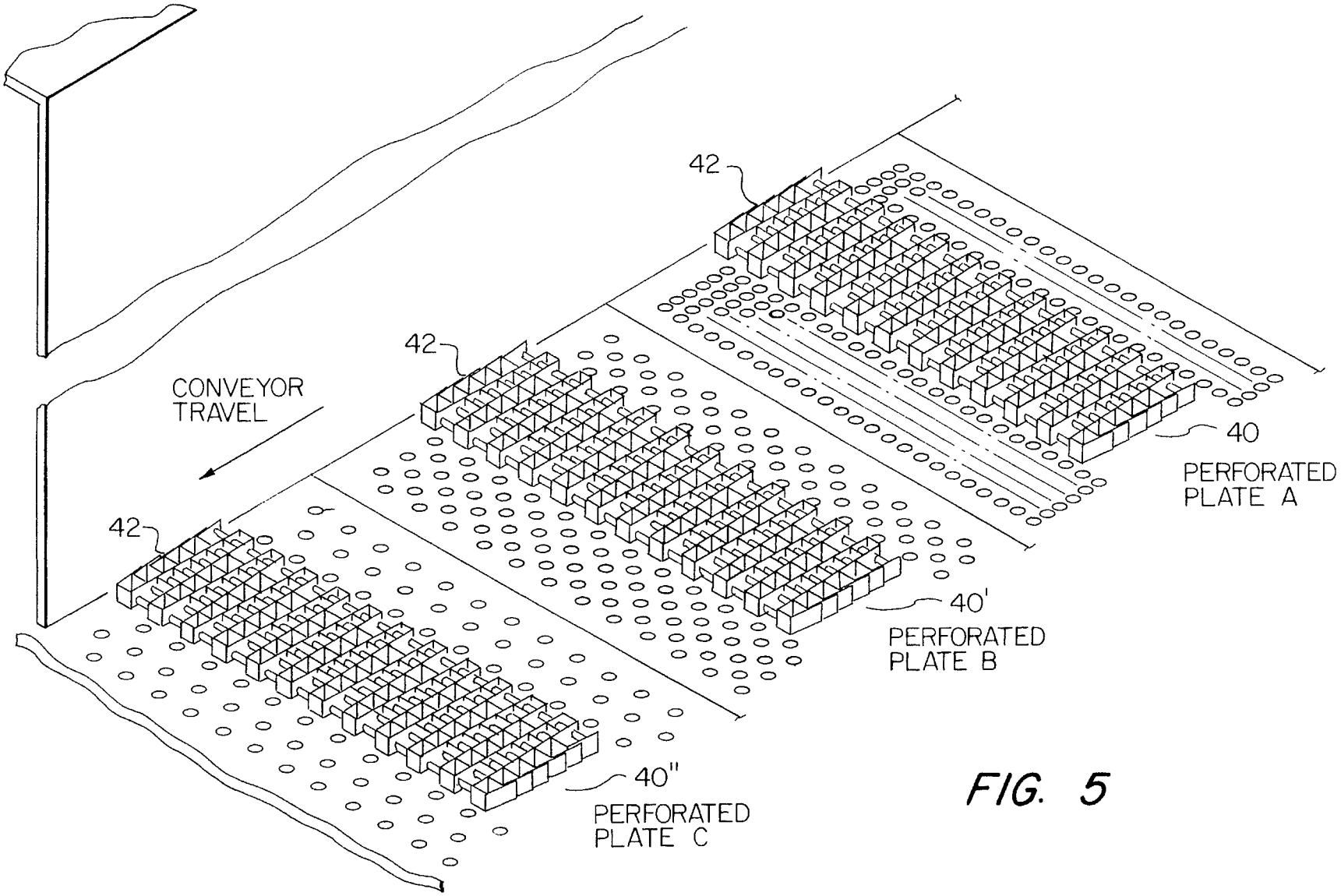
FIG. 5 is a fragmentary schematic of flat wire conveyor belt 42 shown traversing the perforated plates 40, 40' and 40", through zones A, B and C.
Figure 6:
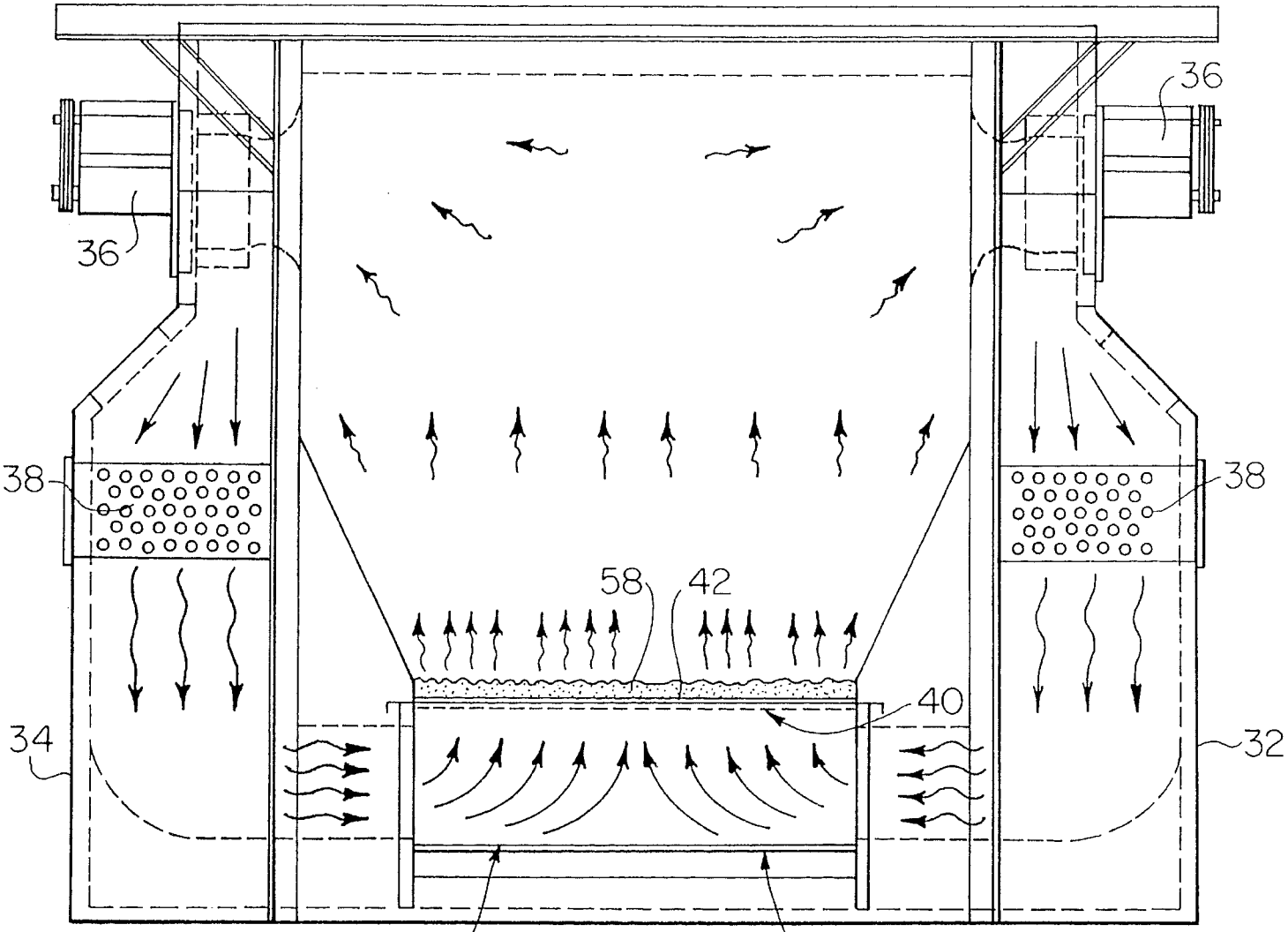
FIG. 6 is a vertical section taken through section line 6—6 of FIG. 8 and showing fans 36 and heat exchangers 38.
Figure 7:
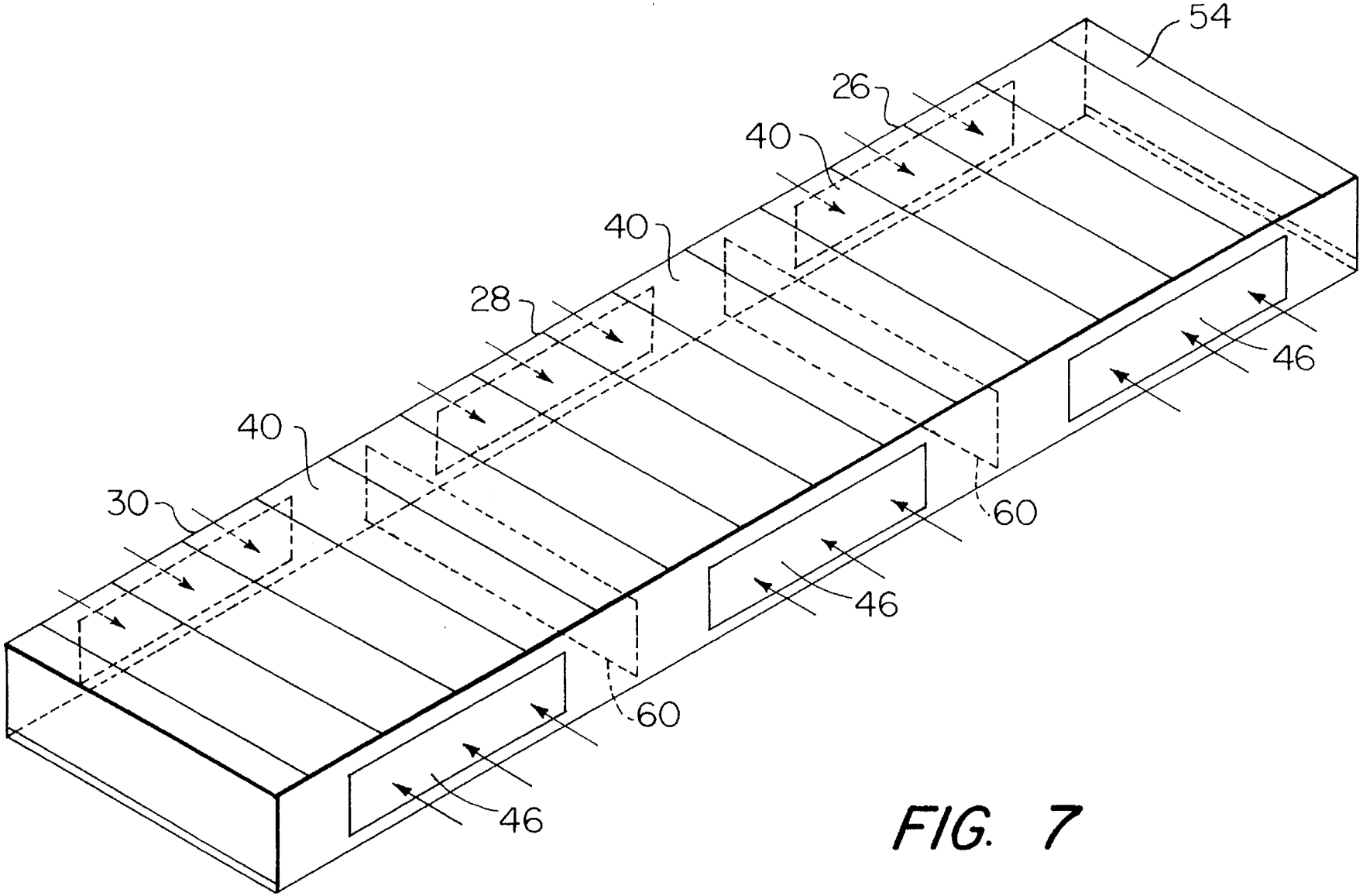
FIG. 7 is an isometric of an integrated drying zone or lower plenum 54, each including individual drying sections 26, 28 and 30.

The lower plenum and its separate sections utilize perforated conveyor belt support plates 40 which provide a restriction to air flow. The velocity of the air flowing through the multiple perforations (orifices) 48 can be directly correlated to the pressure maintained within each of the sections 26, 28, 30 of the plenum. The plenum is large in cross-sectional area which provides low resistance to air flow and, therefore, low pressure drop within the plenum. Perforated plates 40, however, provide a significant restriction in air flow, while providing a uniform pressure within the plenum sections. This uniform pressure allows the air to be distributed uniformly through orifices or holes 48, provided by the perforated plate 40. By varying the location, quantity and/or diameter of holes 48 within perforated plates 40, the flow of air can be controlled such that greater or lesser amounts of air can be delivered to various areas of the perforated plate. Specifically, the perforation patterns are varied to provide for uniformly increasing or decreasing open area, such that there is a corresponding uniform increase or decrease in the air flow through the respective perforated areas. For example, as illustrated in FIG. 5, if the open area of the perforation pattern (i.e. the total area of the orifices or perforations as a portion of the total plate 40 area) is varied from 10% within zone "A" to 5% within zone "B"; the air flow within zone "B" would equal ½ the air flow within zone "A" (provided the the pressures at zone "A" and zone "B" are equal). As will be apparent, the design of the plenum sections and the perforated steel plates 40 easily allows variation in the perforation patterns at 2'–0" or other desired intervals, enabling the thermal air mass to be delivered at variable, yet controlled rates throughout the length of the lower supply plenums 54.

As product travels through the dryer and releases water during the drying process, it becomes lighter. In order to control the amount of air percolating through the product, the perforation patterns in the belt support plates are modified to optimize the thermal air mass delivered to the product to prevent excessive aeration of the product which can cause effects similar to the "blow-hole" phenomenon described earlier. The perforation patterns can be modified throughout the length of the dryer to provide a gradual variation in the thermal air mass delivered to the material layer, as it progresses through the dryer. The perforation patterns can easily be modified at 2'–0" intervals due to the design of the conveyor belt support plates. Since the restriction of air flow is due to the size, quantity and location of the perforations within the stationary conveyor belt support plates, the ability to control the thermal air mass delivered to the product is independent of the conveying system used to transport the product through the dryer. The use of flat wire conveyor belt 42 enables this controlled thermal air mass to be delivered to the superposed product uniformly without lateral movement of air beneath the material layer. The controlled delivery of the air mass in conjunction with controlling the supply air temperature, enables the drying process to be optimized to control the water removal rate, as well as the points at which VOC's are released and removed for incineration.

The preferred embodiment of the flat line wafer dryer method incorporates a controlled distribution of air to the bottom surface of a superposed random array product, allowing the air to be distributed uniformly and at sufficient pressure and velocity to penetrate the bottom surface of the product and percolate upward through the product. This is accomplished through the use of perforated belt support plates 40 in combination with the use of a flat wire conveyor belt 42 (such as Keystone Manufacturing Inc. ½"×½" true flat wire belt). The perforation patterns are varied to allow control of the thermal air mass distribution to provide greater air mass flow at the entrance of the dryer, where the moisture concentration in the wood wafers is greatest (greatest total material mass); and less air mass flow at the exit end of the dryer, where the moisture concentration in the wood wafers is least (least total material mass). The variations in perforation pattern occur at regular intervals within the length of the dryer to provide optimum air distribution and drying performance with constant or variable pressures within each plenum section/zone.

To augment the uniform drying of product, the use of "picker rolls" 50, 52 to reorient the product is incorporated at various stages of the drying process. These "picker rolls" 50 are designed to disrupt the product layer and redistribute or reorient the product to expose fresh surfaces to the air being supplied through the perforated belt support plates. The "picker rolls" further aerate the product and break up any "clumps" of material that tend to block air flow. This ensures that surfaces which cling together, due to surface tension of the water within the product, are exposed to the termal air mass flow and dried.

The area above the product layer progressing through the flat line wafer dryer incorporates chamber walls that are sloped outwardly to present an increasing cross-sectional area, as the air travels upwardly from the product layer toward the intake cones of the circulation fans. This increasing cross-sectional area allows the air mass to expand horizontally, which in turn, limits or reduce gradually the upward air velocity. This reduction of upward velocity, allows larger fines to drop out of the air stream due to gravity, prior to entering the intake cones of the fans used to circulate the thermal air mass throughout the dryer. Allowing the larger fines to drop from the air stream in the upper chamber (plenum) reduces the amount of fines circulated and deposited in the lower supply plenum. This allows the utilization of fines in the finished OSB product with resultant higher product yield.

The preferred embodiment of the flat line wafer dryer method consists of multiple zones to facilitate multiple controlled environments. In the preferred embodiment, the temperature, circulated air volume, transport speeds, wafer volumes (product height), and exhaust air volumes can be varied to accommodate a wide range of drying requirements and conditions.

Figure 8:
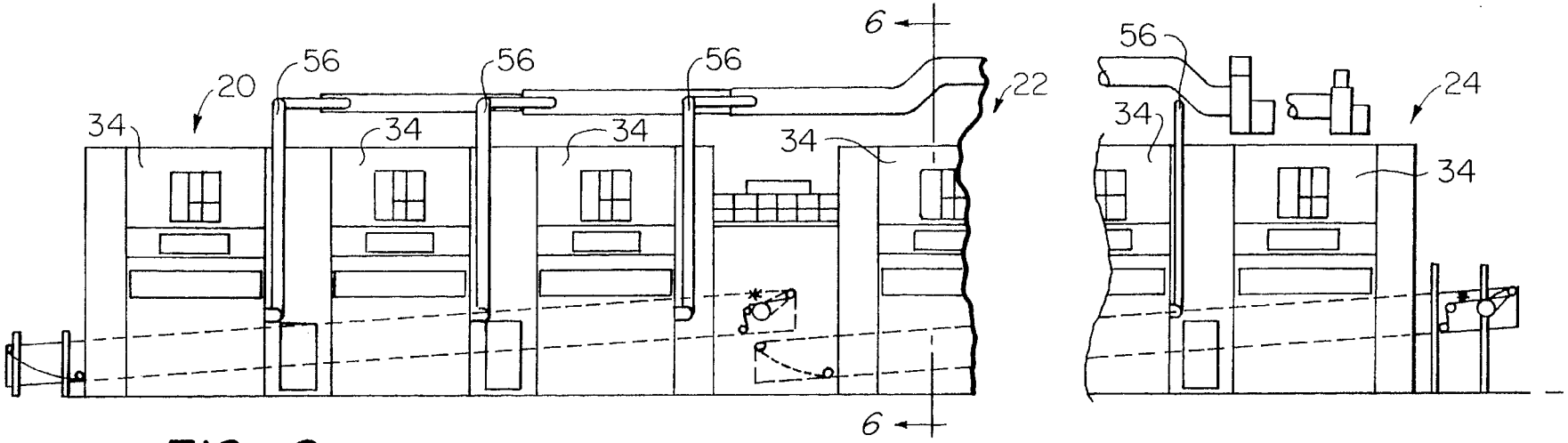
FIG. 8 is a partially fragmentary side elevation of an overall 220 foot, in-line drying system having integrated heating zones 20, 22, and 24.
Figure 9:
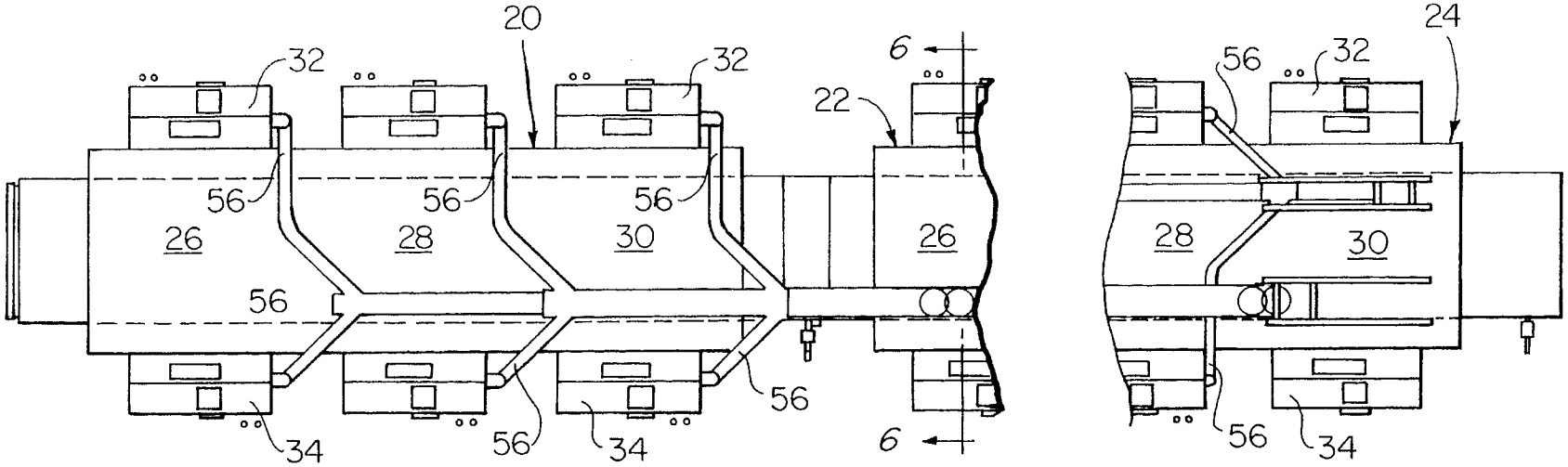
FIG. 9 is a partially fragmentary top plan of the system illustrated in FIG. 8.
Figure 10:
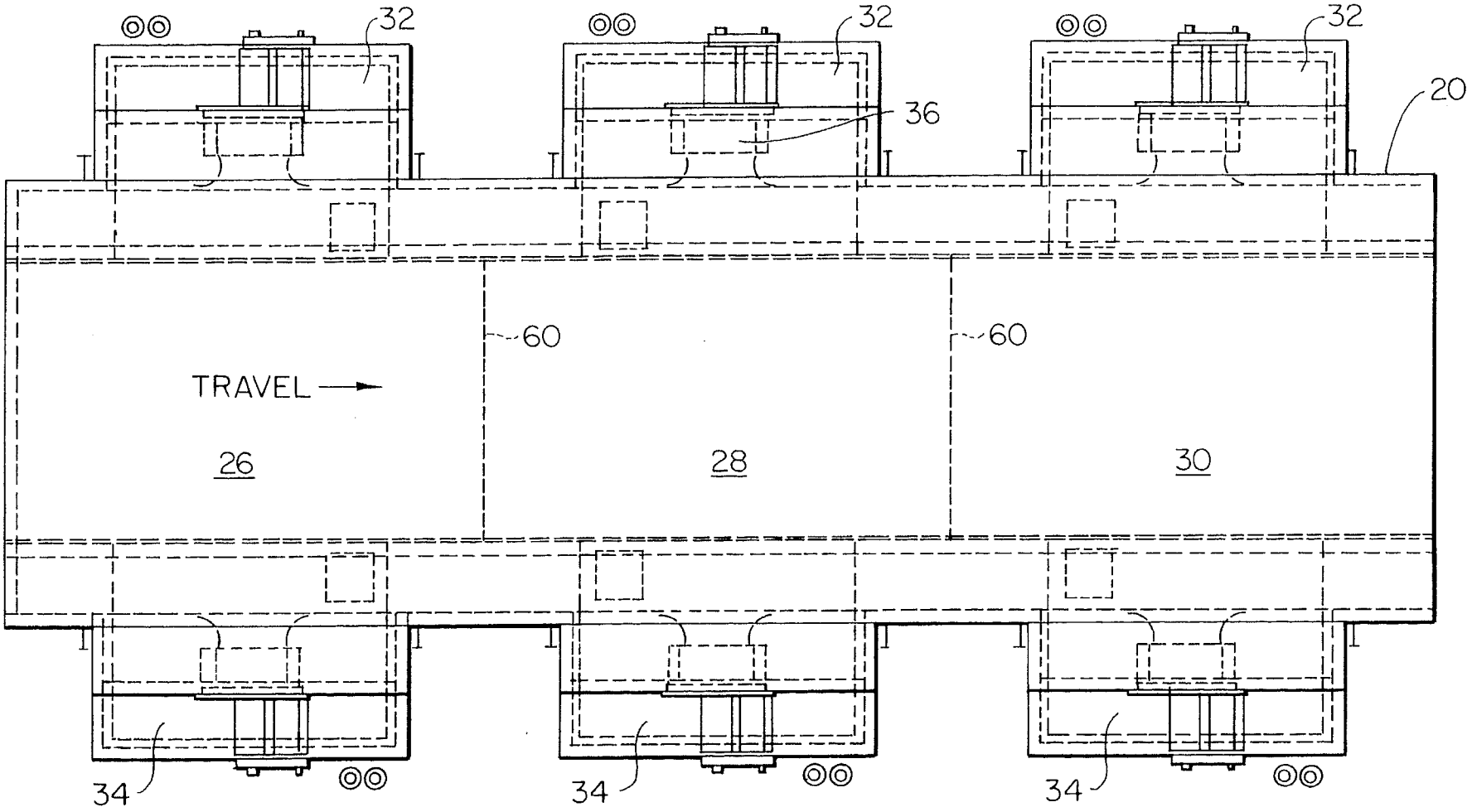
FIG. 10 is a top plan, partially in phantom of the individual heating/drying zone 20.
Figure 11:
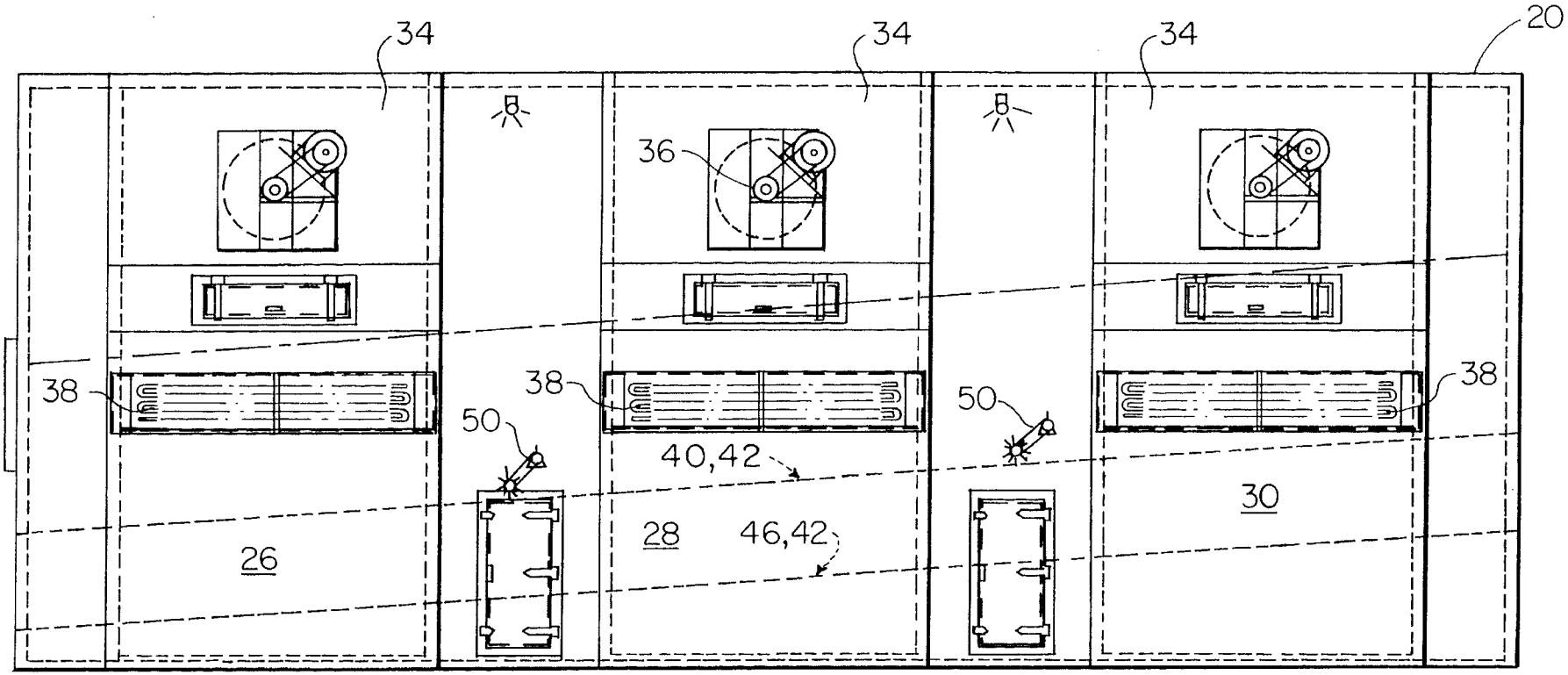
FIG. 11 is a side elevation thereof.

As illustrated in FIG. 8, the preferred embodiment of the flat line wafer dryer incorporates an inclined conveyor within each zone which allows multiple zones to be oriented, in-line such that the material discharged from the conveyor of one zone may cascade downwardly onto the in-feed conveyor of a second zone, which in turn may cascade onto the in-feed conveyor of a third zone, and so on, to accommodate a vast range of production volumes and drying requirements.

The dryer consists of multiple zones that are of consistent design. The design allows for variations in the circulated air volume, perforation patterns in the conveyor support plates, heat exchanger capacity, operating temperature, conveyor transport speeds, exhaust air volumes, etc. without significant changes to the design or fabrication of the dryer.

The flat line wafer dryer offers the following advantages over the use of conventional rotary dryers:

A greater variety of wood species and wafer sizes can be processed without sacrifice to product quality or output.

Wafers and wafer "fines" are not combusted at the suggested low operating temperatures and are fully retrieved, resulting in higher product yield.

There is a reduced risk of fire and fire damage as a result of lower operating temperatures, the continuous removal of fines from the system, the ability to monitor and suppress flames within the drying chamber, and access to the drying chamber by fire fighting personnel.

There is a reduction in the emission of VOC's due to low process temperatures. Further reduction of VOC emissions is possible with the utilization of a waste wood burner as a pollution control device by supplying portions of the exhausted air from various dryer exhaust ports to the primary, secondary and tertiary combustion air inlets of the wood burner.

Due to the low operating temperatures, the suggested dryer may be heated using a variety of secondary heat exchangers (e.g., air-to-air, thermal oil-to-air, and steam-to-air).

There is greater flexibility in the intermediate control of the drying process. The drying process within each section can be regulated using various degrees of control of the following process conditions: recirculated air volumes; variable distribution of air to compensate for reduction of product mass as it progresses through the dryer; recirculated air and heat exchanger temperatures; and exhaust air volumes. The ability to change these parameters within each 20'–0" section of the dryer results in multiple controlled environments. By locating exhaust ports at each of the heater housings, it is possible to control the exhaust volumes from the individual sections, as well as direct the exhaust to an incineration device if heavily laden with VOC's, or to atmosphere if it contains mostly water with low VOC concentration. This flexibility in establishing controlled zones allows for removal of VOC's at optimum points within the dryer and greater control of the exhaust air contents.

We claim:

1. Flatline method of drying wafers comprising:

a. advancing wafers in random array on a flat wire conveyor belt having laterally restrictive openings with the wood wafers being supported upon the conveyor and the conveyor being supported on a planar surface, such that said wafers are substantially suspended without contact above the planar surface;

b. forcing heated air upwardly through spaced-apart holes of varying diameter and distribution defined in the planar surface, while laterally shielding heated air above the planar surface, then forcing heated air through the random array of advancing wafers, wherein the size and distribution of holes within the planar surface are a control of distributing heated air;

c. evacuating heated air and accumulated moisture from above said advancing wafers, and d. recovering wafers at an end of the planar surface.

2. Flatline method of drying wafers as in claim 1, including re-orienting the drying wafers simultaneously with said advancing.

3. Flatline method of drying wafers as in claim 2, wherein heated air is forced through linearly defined zones of holes spaced apart at different distances.

4. Flatline method of drying wafers as in claim 3, including independently varying the temperature of heated air within the linearly defined zones.

5. Flatline method of drying wafers as in claim 4, wherein the sizes and spaced distribution of holes within said linearly defined zones are correlated with the temperature of heated air, so as to obtain wafers with a desired moisture content.

6. Flatline method of drying wafers as in claim 3, wherein said forcing of heated air upwardly disrupts the random array of drying wafers.

7. Flatline method of drying wafers as in claim 1, including collecting and removing fines from beneath said advancing wafers by simultaneously scraping said planar surface.

8. Flatline method of drying wafers as in claim 7, including limiting said forcing of heated air, so as to prevent the drying wafers from becoming airborne.

9. Flatline method of drying wafers as in claim 1, including collecting and removing fines from within the lower supply plenum by simultaneously scraping said "return conveyor belt" planar surface.

* * * * *